US006619400B2

(12) United States Patent
Brunet

(10) Patent No.: US 6,619,400 B2
(45) Date of Patent: Sep. 16, 2003

(54) APPARATUS AND METHOD TO COMPLETE A MULTILATERAL JUNCTION

(75) Inventor: Charles G. Brunet, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 63 days.

(21) Appl. No.: 09/897,520

(22) Filed: Jul. 2, 2001

(65) Prior Publication Data

US 2002/0000319 A1 Jan. 3, 2002

Related U.S. Application Data

(60) Provisional application No. 60/215,528, filed on Jun. 30, 2000, and provisional application No. 60/215,530, filed on Jun. 30, 2000.

(51) Int. Cl.[7] ..... E21B 19/16; E21B 47/00

(52) U.S. Cl. ..... 166/313; 166/50; 166/117.5

(58) Field of Search ..... 166/313, 50, 117.5, 166/117.6, 255.3

(56) References Cited

U.S. PATENT DOCUMENTS

| | | | | |
|---|---|---|---|---|
| 4,007,783 A | 2/1977 | Amancharla et al. | ..... | 166/135 |
| 5,322,127 A | 6/1994 | McNair et al. | ..... | 166/313 |
| 5,477,925 A | 12/1995 | Trahan et al. | ..... | 166/382 |
| 6,009,943 A | 1/2000 | Yokley et al. | ..... | 166/125 |
| 6,012,526 A | 1/2000 | Jennings et al. | ..... | 166/298 |
| 6,244,340 B1 | 6/2001 | McGlothen et al. | ..... | 166/255.3 |

FOREIGN PATENT DOCUMENTS

| | | | | |
|---|---|---|---|---|
| EP | 0 859 121 | 8/1998 | ..... | E21B/23/00 |
| WO | WO 98/45570 | 10/1998 | ..... | E21B/23/00 |
| WO | WO 98/58151 | 12/1998 | ..... | W21B/7/06 |
| WO | WO 01/25587 | 4/2001 | ..... | E21B/7/08 |

OTHER PUBLICATIONS

PCT International Search Report from PCT/GB 01/02958, Dated Jan. 31, 2002.

PCT Partial International Search Report from PCT/GB 01/02938, Dated Nov. 23, 2001.

*Primary Examiner*—William Neuder

(74) *Attorney, Agent, or Firm*—Moser, Patterson & Sheridan, L.L.P.

(57) ABSTRACT

An apparatus for locating a first tubular with respect to a window in a second tubular including at least one member extending from an outer surface of a liner for aligning the liner with respect to a window in a casing of a primary wellbore. In one aspect, the invention includes a key and a no-go obstruction to rotationally and axially align the apparatus with the window.

56 Claims, 15 Drawing Sheets

APPARATUS AND METHOD TO COMPLETE A MULTILATERAL JUNCTION

RELATED APPLICATIONS

This application claims priority to U.S. Provisional Application Ser. No. 60/215,528 filed Jun. 30, 2000 and Ser. No. 60/215,530 filed Jun. 30, 2000.

BACKGROUND OF THE INVENTION

1. Field of the Invention

The present invention relates generally to tie back systems for lateral wellbores. More specifically, the invention relates to apparatus and methods for locating and setting a tie back system in a lateral wellbore. More specifically still, the present invention relates to an apparatus and methods for orienting a tie back assembly in a wellbore adjacent a casing window using a key and keyway and a no-go obstruction to rotationally and axially locate the liner with respect to the casing window.

2. Description of the Related Art

Lateral wellbores are routinely used to more effectively and efficiently access hydrocarbon-bearing formations. Typically, the lateral wellbores are formed from a window that is formed in the casing of a central or primary wellbore. The windows are either preformed at the surface of the well prior to installation of the casing or they are cut in situ using some type of milling process. With the window formed, the lateral wellbore is formed with a drill bit and drill string. Thereafter, liner is run into the lateral wellbore and "tied back" to the surface of the well permitting collection of hydrocarbons from the lateral wellbore.

Lateral tie back systems are well known. Various types are in use, including flush systems that allow a lateral liner to be mechanically tied back to the main casing at the window opening without the tie back means significantly extending into the primary wellbore. Other systems currently available place the liner in the main casing then "chop off" the portion of the liner that extends up into the main casing. Still other systems available utilize some form of liner hanger device placed in the main casing to connect the liner in the lateral wellbore to the primary wellbore. Some examples of lateral tie-back systems are detailed in U.S. Pat. Nos. 5,944,108 and 5,477,925 and those patents are incorporated herein by reference in their entirety.

There are problems with the currently available tie back systems. In those systems which utilize a liner hanger device placed in the main casing, the internal diameters of both the main casing and the liner are significantly restricted. Flush systems currently available are restricted to use in applications which use pre-milled windows containing control profiles precisely machined on surface prior to running in the wellbore which allow the tie back means at the upper end of the liner to be accurately landed in and connected to the window. Systems that sever a section of the liner extending into the primary wellbore require a milling process which is time consuming and expensive and always carries the risk of loss of the entire wellbore during the installation process. Another problem with conventional tie back systems is that survey devices must be used in the installation process in order to properly locate the assembly, which is expensive and time consuming. Existing liner hanger systems that use a permanent orientation device mounted on the tie back assembly to orient the liner window to the main casing take up space and significantly reduces the internal diameter of both the liner in the lateral wellbore as well as the main casing. Another problem with existing liner hanger systems using the bottom of the window for orientation is that they are set in compression, which limits the use of this equipment from moving platforms, such as floating rigs or drillships.

There is a need therefore, for an apparatus and method to complete a multilateral junction that will overcome the shortcomings of the prior art devices. There is a further need for an apparatus that can be installed in both existing and new wellbores and that does not restrict the internal diameter of the primary wellbore. There is a further need therefore, for an apparatus and method to complete a multilateral junction that allows selective access to both the lateral or to the primary wellbore.

There is a further need therefore, for a tie back system that more effectively facilitates the placement and hanging of a liner in a lateral wellbore. There is a further need for a tie back system that can be oriented using tension rather than compressive forces. There is yet a further need for a tie back system that can be rotationally located and axially located in a central wellbore using the central wellbore casing and/or a window therein as a guide. There is yet a further need for a tie back system that can be placed in a wellbore while minimizing the obstructions in the liner or the casing after installation.

There is yet a further need, for a tie back system that can be cemented in a wellbore and allows full casing access through the junction without restriction and which does not require any milling or the liner with the accompanying generation of metal cuttings which can cause numerous problem like the sticking of drilling and completion tools.

SUMMARY OF THE INVENTION

The present invention provides an apparatus and methods to complete a lateral wellbore that can be utilized for existing or new wells. The apparatus can be set in tension with positive confirmation on surface of correct orientation and position. Additionally, the apparatus does not restrict the internal diameter of the liner or the central wellbore and permits full access to both the lateral and the primary wellbore below the junction.

In one aspect, the invention includes a tie back assembly disposed at an upper end of a liner string. The tie back assembly includes a hanger, a packer and a tubular housing. The housing includes a liner window formed in a wall thereof to permit access to the lower primary wellbore. An inner tube is disposed within the housing and includes a key disposed on an outer surface for alignment with a window formed in a wall of the casing and a no-go obstruction which is constructed and arranged to contact a lower portion of the casing window to axially locate the tie back assembly in the primary wellbore.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 2:
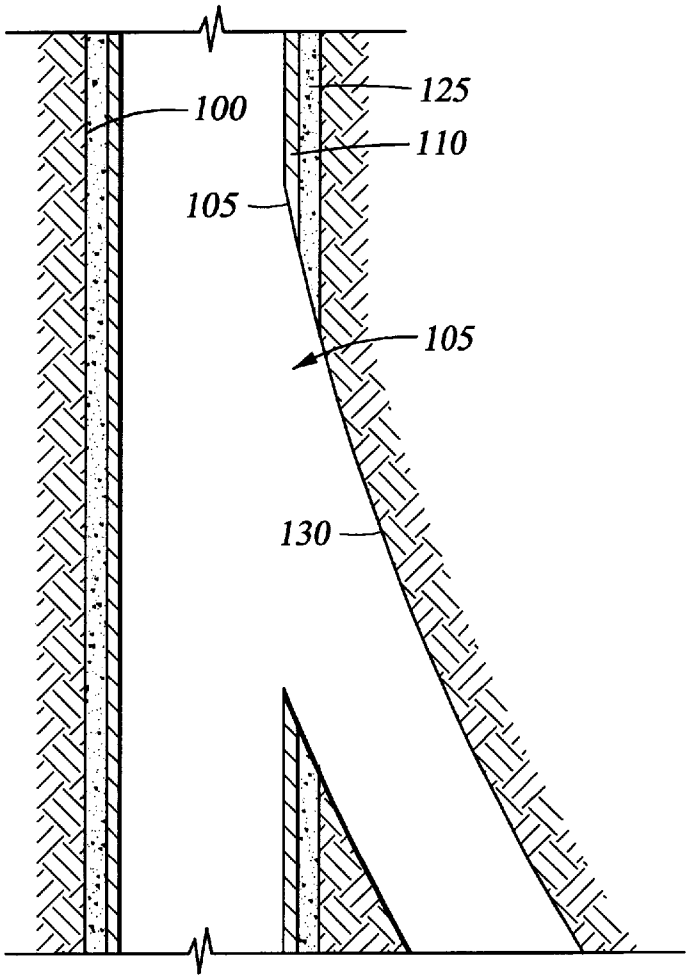
FIG. 2 is a section view of the wellbore of FIG. 1, with the whipstock and anchor removed.
Figure 1:
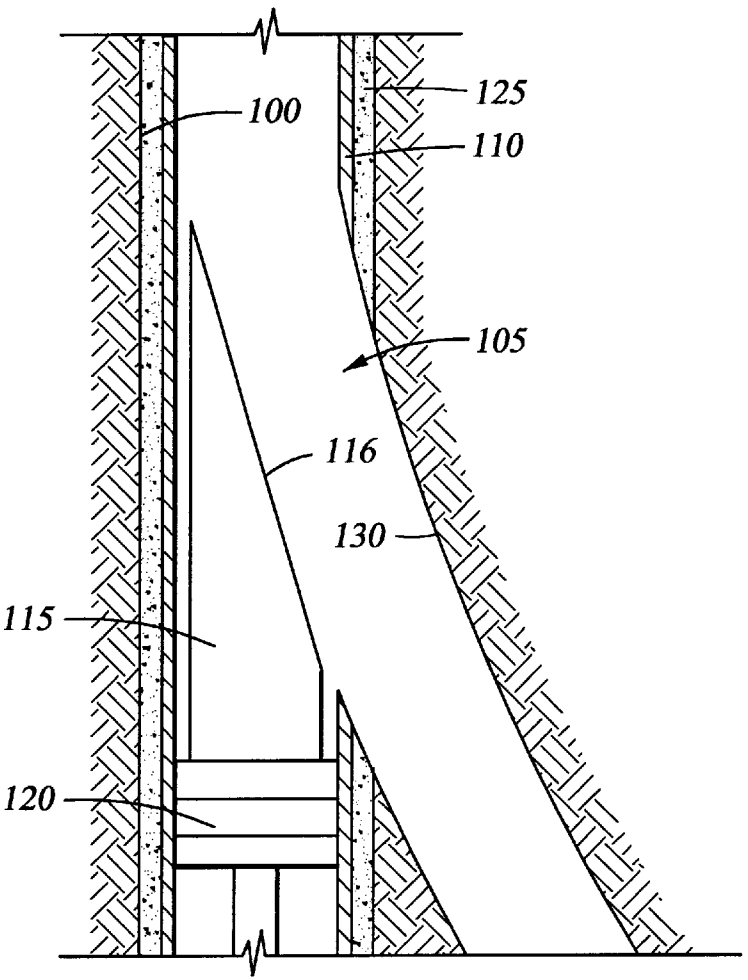
FIG. 1 is a section view of a cemented wellbore with a casing window formed in casing and a whipstock and anchor installed in the wellbore therebelow.

FIG. 1 is a section view of a cemented wellbore 100 with window 105 formed in the casing 110 thereof and a whipstock 115 and anchor 120 installed in the primary wellbore 100 below the window 105. An annular area between the casing 110 and the wellbore 100 is filled with cement 125 to facilitate the isolation of certain parts of the wellbore 100 and to strengthen the borehole. In one embodiment of the invention, the window 105 in the casing 110 is a preformed window and includes a keyway (not shown) at an upper end thereof. The whipstock 115 and anchor 120 are placed in the wellbore 100 to facilitate the formation of a lateral wellbore 130. Using the concave 116 face of the whipstock 115, a drilling bit on a drill string (not shown) is diverted into the window 105 and the lateral wellbore 130 is formed. When the window is not preformed, a milling device is used to form a window in the casing prior to the formation of the lateral wellbore. FIG. 2 is a section view of the wellbore 100 showing the completed lateral wellbore 130 extending therefrom and the whipstock 115 and packer 120 removed, leaving the wellbore 100 ready for the installation of a liner and tie back system.

Figure 3:
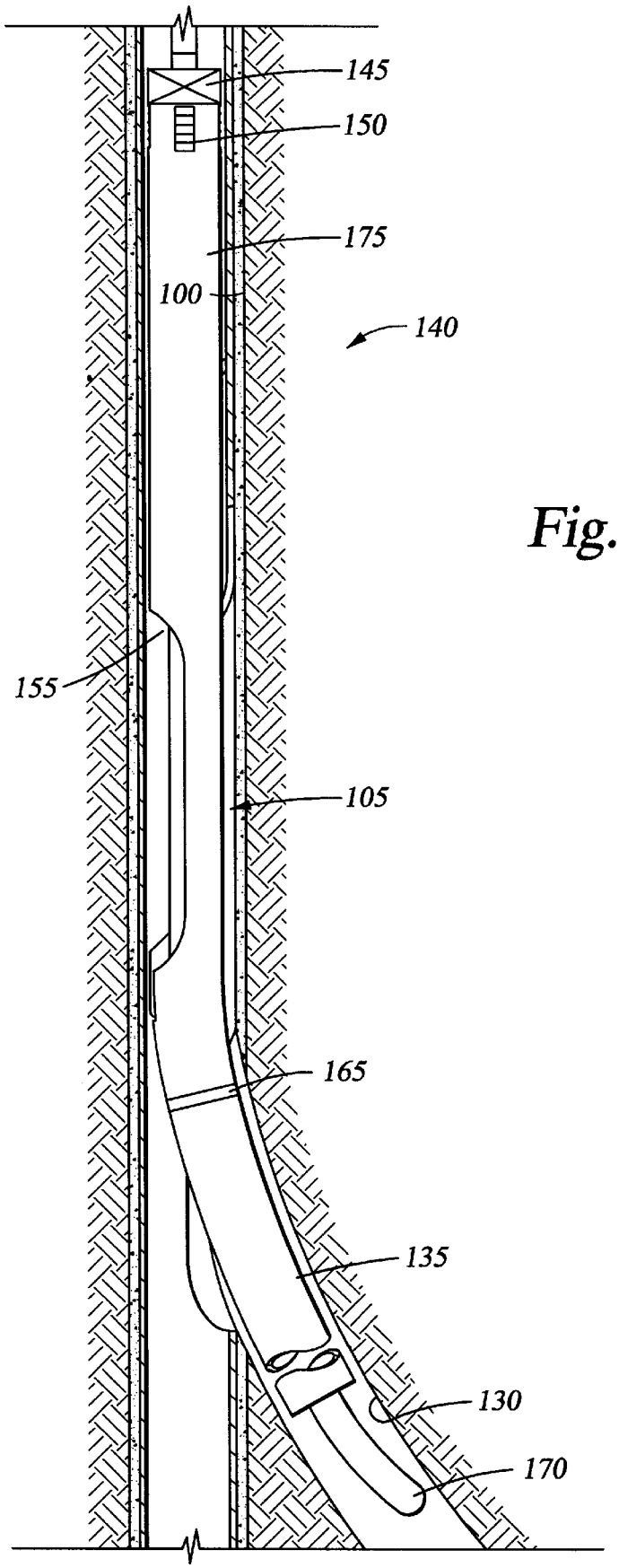
FIG. 3 is a section view of the wellbore showing a tie back assembly in the run in position.
Figure 3A:
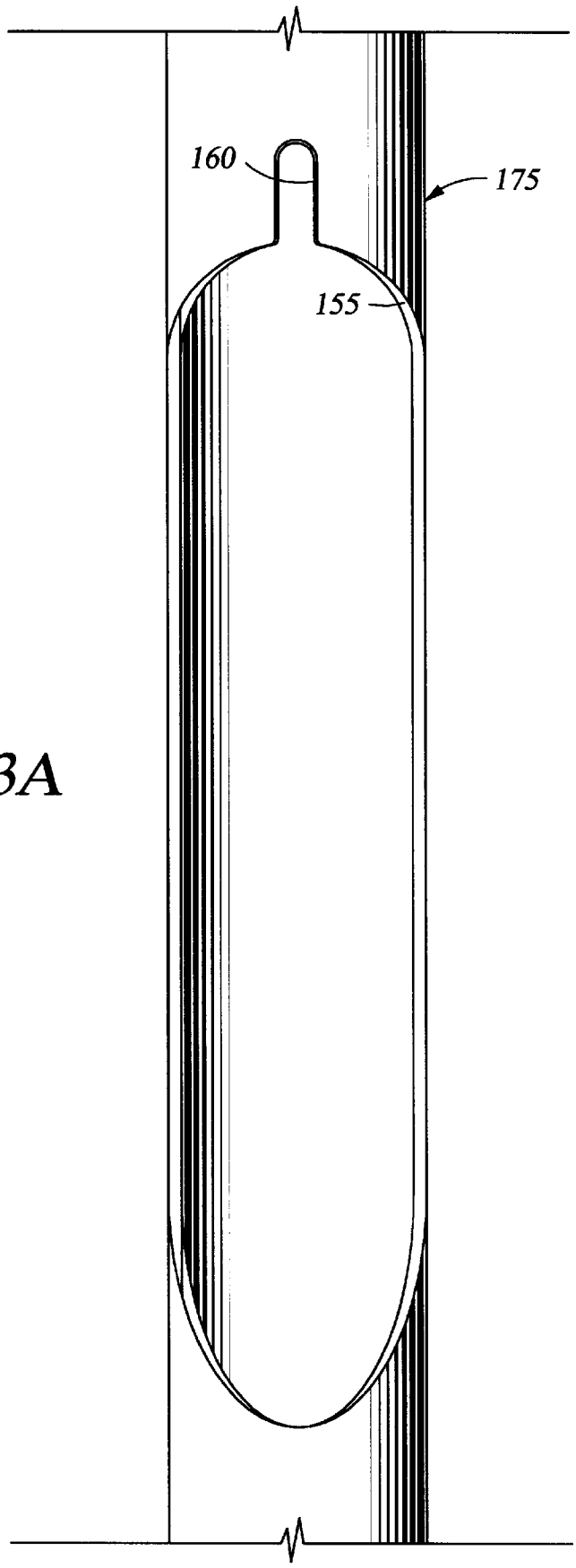
FIG. 3A is an elevation of the tubular housing of the assembly illustrating a liner window formed therein with a key-way formed at an upper end thereof.

FIG. 3 illustrates a liner 135 with the tie back assembly 140 of the present invention disposed at an upper end thereof. The assembly 140 is shown in a run-in position with the liner 135 extending into the lateral wellbore 130. The assembly 140 is constructed and arranged to be set in the primary wellbore 100, permitting the liner 135 to extend into the lateral wellbore 130 via the window 105. The tie back assembly 140 basically consists of a steel tubular housing 175 with a packer 145 and a liner hanger 150 disposed thereabove. The housing 175 includes a liner window 155 and a liner window keyway 160 formed at an upper end of the window 155, as shown in FIG. 3A. The liner window 155 is a longitudinal opening located in the wall of the housing 175 and is of a size to allow an object of the full internal drift of the liner diameter to pass through. A swivel 165 is located between the assembly 140 and a bent joint 170. The swivel 165 allows the liner 135 to rotate independently of the assembly 140 to facilitate insertion of the liner 135 into the lateral wellbore 130. The swivel 165 contains an attachment means, such as a threaded connection, on both its upper and lower ends to allow attachment to the assembly 140 and liner 135. The bent joint 170 is a curved section of tubular designed to be pointed in the direction of a casing window 105 to facilitate the movement of the liner 135 into the lateral wellbore 130 from the primary wellbore 100. The assembly 140 is run into the primary wellbore 100 on a run-in string 174.

The liner hanger 150 and packer 145 are well known in the art and are located at the trailing or uphole end of the assembly 140. The liner hanger 150 is well known in the art and is typically located below and threadably connected to the packer 145 for the purpose of supporting the weight of the liner 135 in the lateral wellbore 130. The liner hanger 150 contains slips, or gripping devices constructed from hardened metal and which are well known in the art and engage the inside surface of the main casing 110 to support the weight of the liner 135. The liner hanger 150 is typically activated and set hydraulically using pressurized fluid from the surface. The packer 145 is well known in the art and is used to seal the annulus between the tie back assembly 140 and the inside surface of the main casing 110. In the embodiment shown in FIG. 3, the packer 145 is threadably connected on its lower end to the upper end of the liner hanger 150. The packer 145 is typically set in compression.

The housing 175 has a threaded connection on its upper end that can be made up to the lower connection of the liner hanger 150. The lower end of the housing 175 has a threaded connection that can be made up to the swivel device 165 located on the lower end of the assembly 140, which is attached to the upper end of the liner 135. A spring-loaded key 180 extends outwards from the surface of the housing 175 to contact a keyway 190 formed at the upper portion of the casing window 105. In the preferred embodiment, the key is spring-loaded to prevent interference between the key and the wall of the casing during run in of the assembly.

FIG. 3A is an elevation of the tubular housing of the assembly illustrating a liner window formed therein with a key-way formed at an upper end thereof. The liner window 155 includes a longitudinal opening on the outer surface of the housing 175 and is located on the opposite side of the housing 175 from the key 180 to permit access to the main casing 110 after the tie back assembly 140 is set in place. The liner window keyway 160 is a keyway, or machined channel of known profile, which is located on the upper end of the liner window 155 to allow re-entry or completion equipment to be landed in known orientation and position with respect to the liner window 155 and allows selective access to the main casing 110 below the junction or to the lateral wellbore 130.

The inner tube 185 is disposed coaxially on the inside of the housing 175 of the assembly 140. The inner tube 185 is a steel tubular section having an outwardly extending no-go obstruction 190 formed thereupon for locating the assembly 140 axially with respect to the casing window 105. A running tool (not shown) is disposed inside the assembly and is used to release the liner 135 and the assembly 140 and to remove the inner tube 185 after the assembly 140 has been set in the wellbore 100. In one embodiment, the key 180 as well as the no-go obstruction 190 is located on the inner tube and is therefore removable from the wellbore along with the run-in string.

Figure 4:
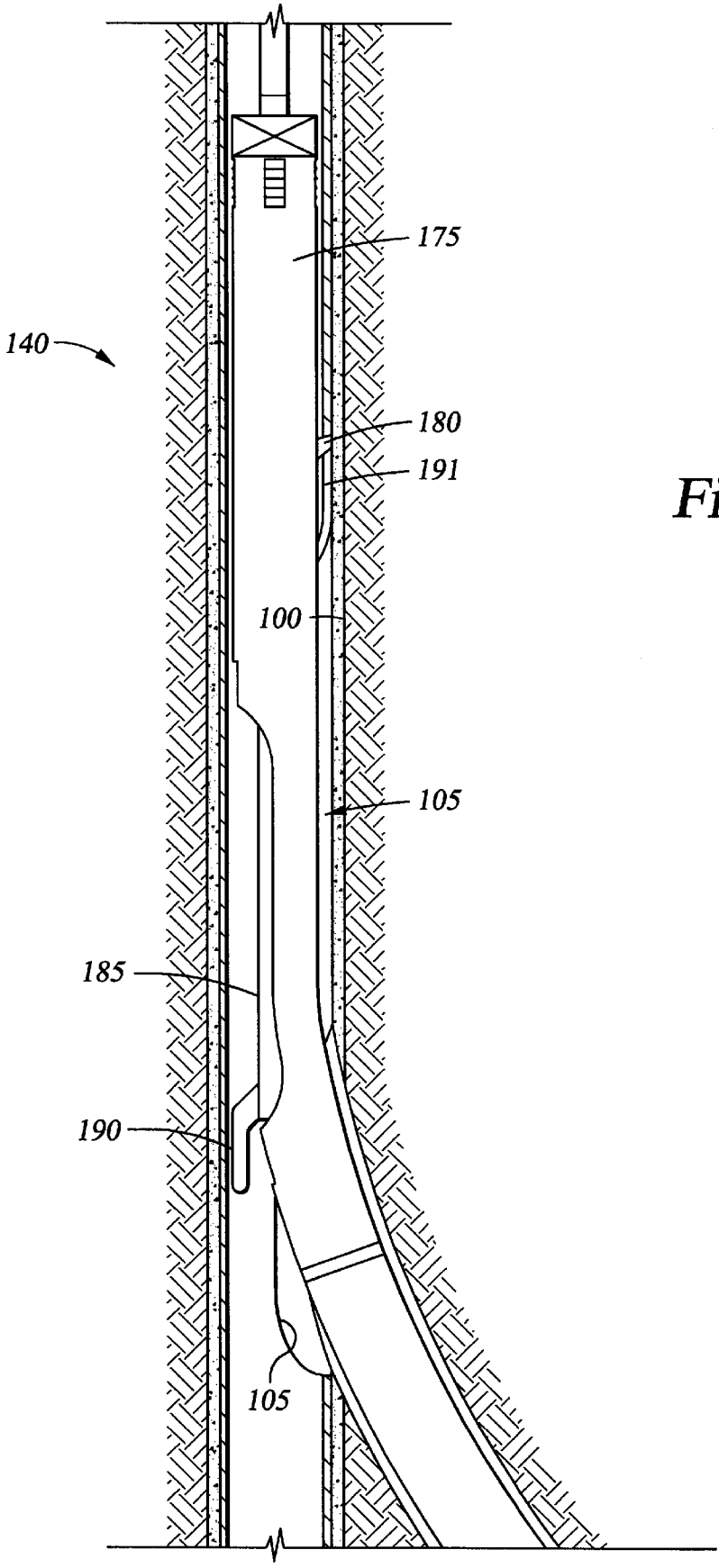
FIG. 4 is a section view of the wellbore showing a key located on the tie back assembly aligned in the wellbore with respect to a window.

FIG. 4 is a section view of the wellbore 100 showing the key 180 of the housing 175 aligned in the keyway 191. In practice, the assembly 140 is lowered to a predetermined location in the wellbore 100 and is then rotated until the spring-loaded key 180 intersects the casing window 105. Thereafter, the assembly 140 is raised in the wellbore 100 and the extended key 180 is aligned in the relatively narrow keyway 191 formed at the top of the casing window 105. With the key 180 aligned in the keyway 191, the assembly 140 is rotationally positioned within the wellbore 100. As shown, the inner tube 185 with an outwardly extending obstruction 190, is held above the bottom of the casing window 105.

Figure 5:
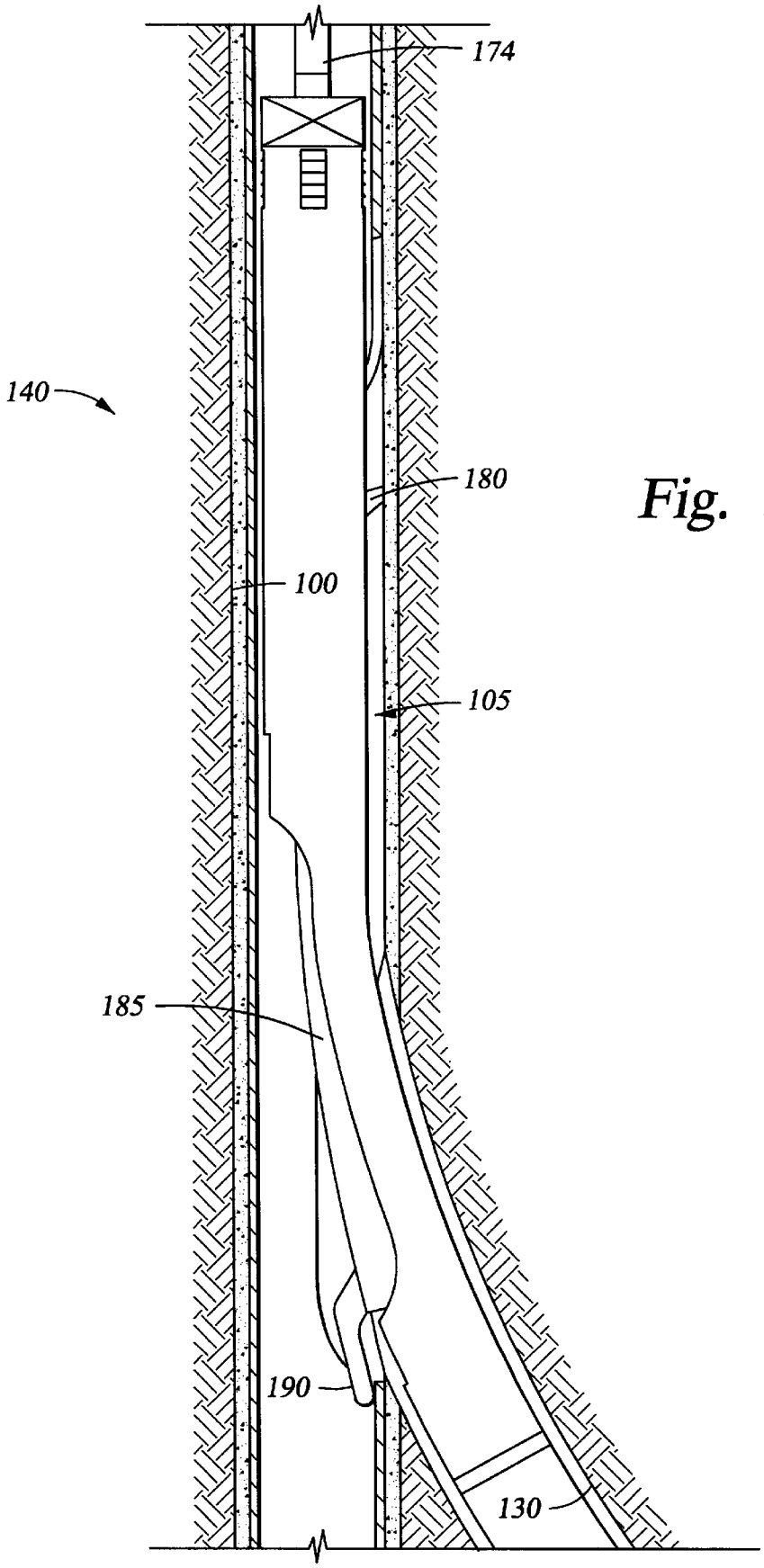
FIG. 5 shows a no-go obstruction of the tie back assembly in contact with a lower surface of the window.
Figure 5A:
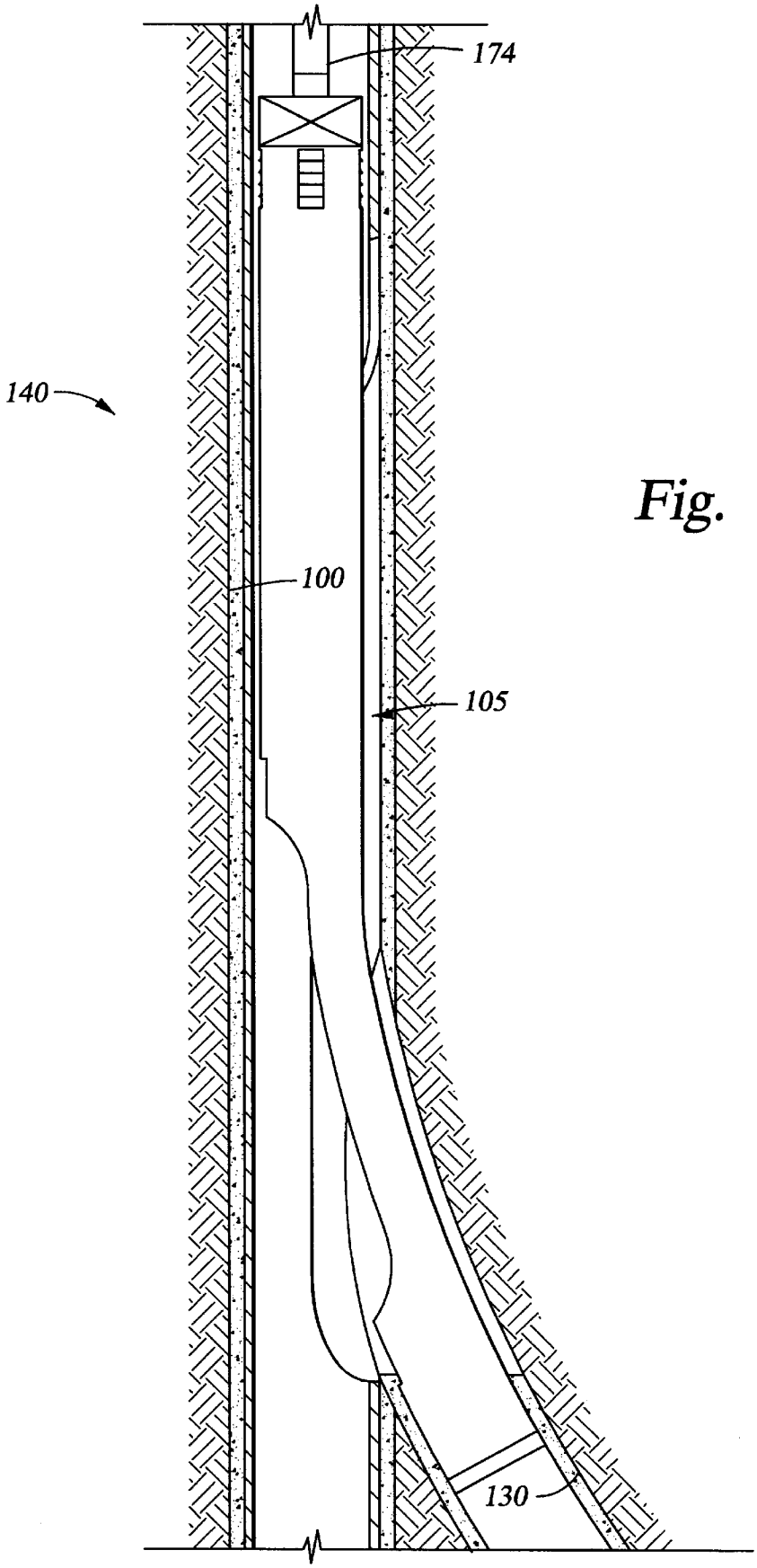
FIG. 5A shows the tie back assembly hung in the primary wellbore and an inner tube with the no-go obstruction and key removed with the run-in string, leaving the main bore though the tie back assembly open for access.

FIG. 5 shows the assembly 140 after it has been lowered in the wellbore 100 to a position whereby the no-go obstruction 190 of the inner tube 185 has interfered with the bottom surface of the casing window 105, thereby limiting the downward motion of the assembly 140 within the primary wellbore 100 and axially aligning the assembly 140 with respect to the casing window 105. In FIG. 5, the no-go obstruction 190 is a single member designed to contact the lower key way or lower apex of the window. However, the no-go obstruction could be two separate, spaced members that contact the lower sides of the window. Additionally, the obstruction could be designed wherein it contacts the liner at a point below the window, thereby not even temporarily restricting access through the window. FIG. 5A shows the tie back assembly 140 hung in the primary wellbore 100. As illustrated, the inner tube 185 with the no-go obstruction 190 has been removed with the run-in string 174, leaving the primary 100 and lateral 130 wellbores clear of obstructions.

In one embodiment, the no-go obstruction is a fixed obstruction. In another embodiment, the no-go obstruction is spring loaded and remains recessed in a housing formed on the inner tube wall until actuated by some event, like the actuation of the spring loaded key. In another embodiment, a simple mechanical linkage runs between the key and the obstruction whereby the obstruction is released only upon the engagement of the key in the keyway or in the naturally formed apex of the window.

Figure 6:
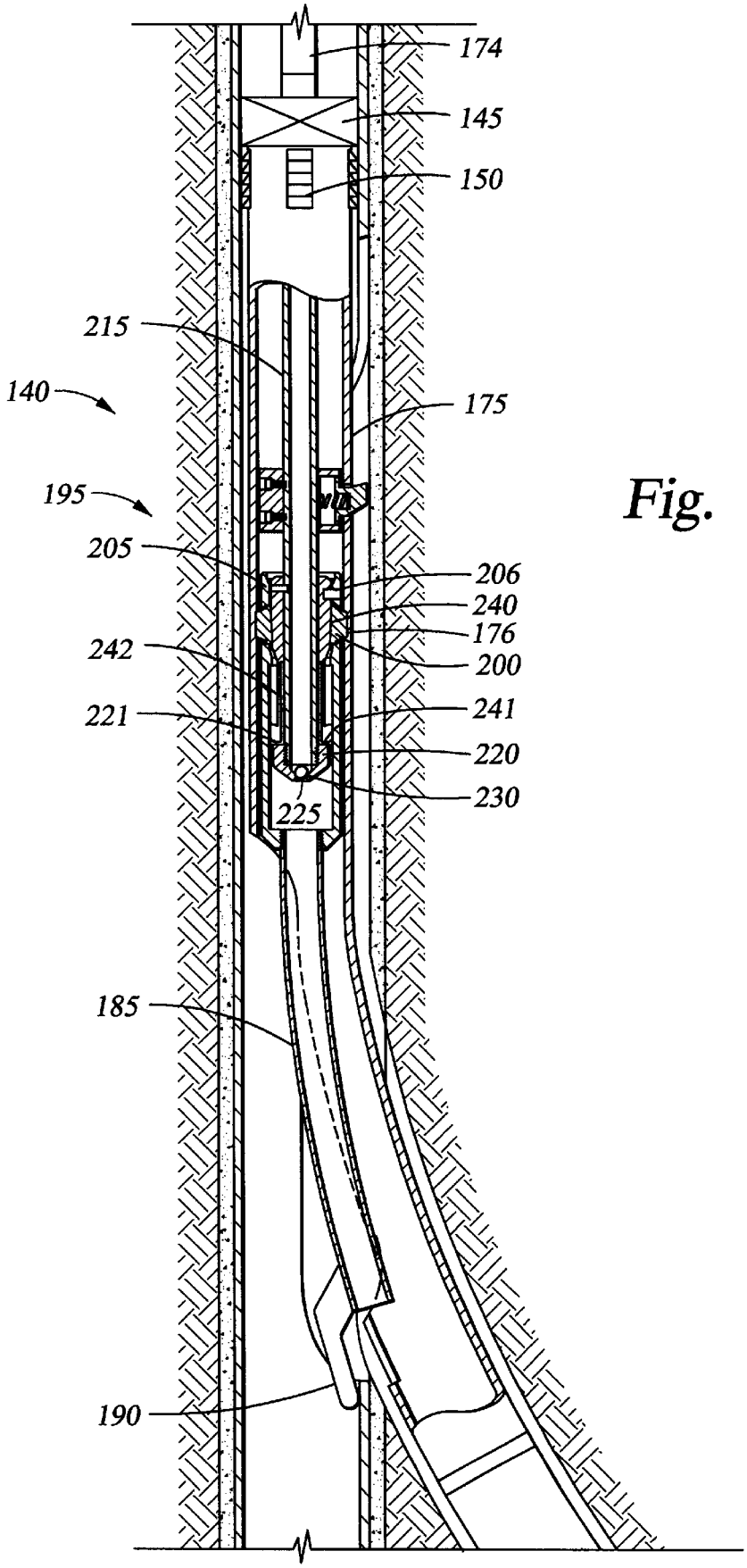
FIG. 6 is a section view of a mechanical release mechanism used to separate a run-in string and the inner tube from the assembly.
Figure 7:
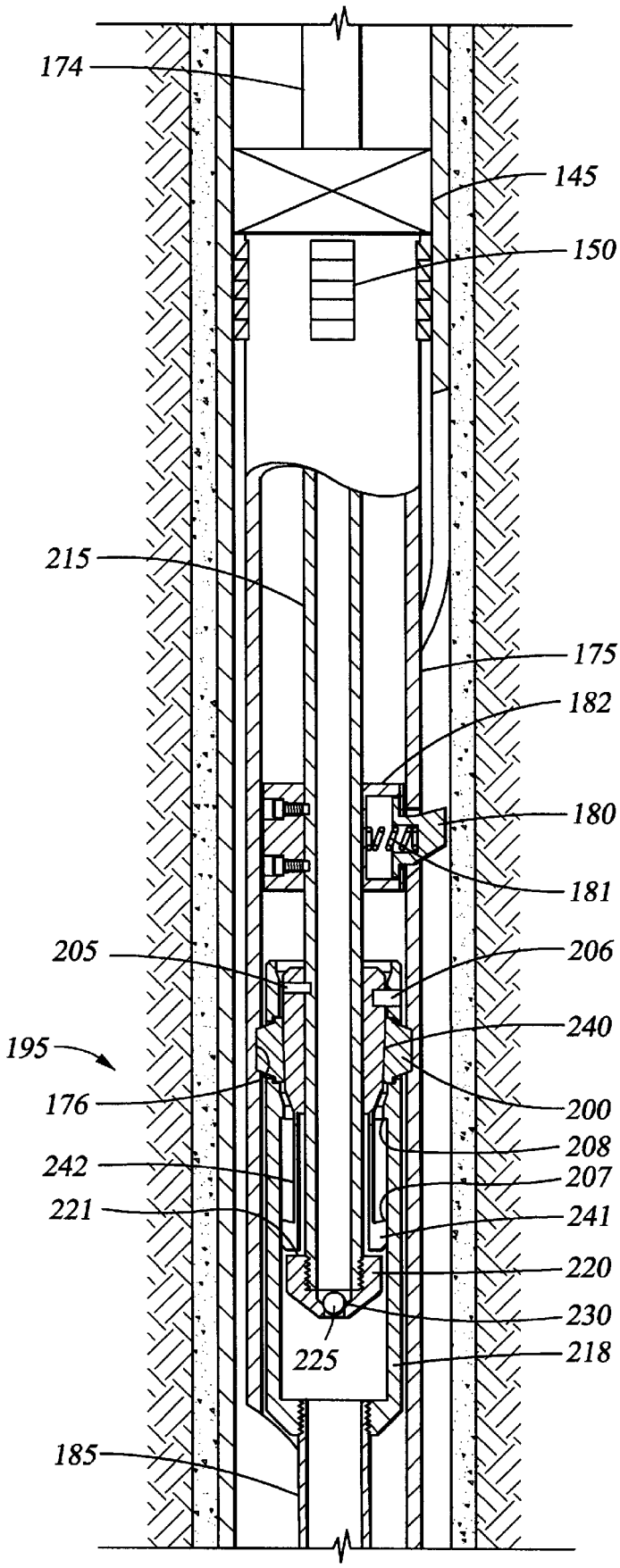
FIG. 7 is an enlarged view of the release assembly.

FIG. 6 is a section view of a release mechanism 195 used to separate the run-in string 174 and the inner tube 185 from the assembly 140 and FIG. 7 is an enlarged view of the release assembly 195. In the embodiment shown, the release mechanism assembly 195 includes a central mandrel 215 threadably attached to a lower end of the run-in string 174. The mandrel 215 extends through the assembly 195 and includes a pick up nut 220 attached at a lower end thereof and ball seat 230 formed in the interior of the pick up nut. The pick up nut 220 has an enlarged outer diameter and is used to contact and lift portions of the assembly 140 as the mandrel 215 is removed from the assembly 140 after the tie back assembly 140 is set in the wellbore 100. In FIG. 6, a ball 225 is shown in the ball seat 230. The ball 225 permits fluid pressure to be built up in the mandrel 215 bore in order to actuate hydraulic devices like the packer 145 and hanger 150. Typically, the hanger 150 and packer 145 are actuated after the liner is completely aligned with respect to the window and before the run-in string and inner tube 185 are removed.

Disposed around the mandrel 215 is an expander tube 240. The expander tube 240 is temporarily connected to the mandrel 215 with a shearable connection 205. The expander tube 240 is disposed within and temporarily attached to the inner tube 185 with a shearable connection 206. A pair of locking dogs 200 are housed in a groove 176 formed in the interior wall of the housing 175. The dogs 200 extend through an opening in the wall of the inner tube 185 and serve to temporarily connect the inner tube 185 to the housing 175.

In order to remove the mandrel 215 and the inner tube 185 from the tie back assembly 140, a downward force is applied from the surface of the well to the run-in string 174, thereby creating a downward force on the mandrel 215. The force is sufficient to overcome the shear strength of the shearable connection 205 between the expander tube 240 and the mandrel 215. This allows the spring-loaded key 180 to retract as it moves downward. The housing 175 acts against the bottom surface of the key 180 and overcomes the force of the spring 181. The spring 181 and key 180 are contained in a housing 182 which is attached to the mandrel 215. By pushing down on the mandrel 215 and retracting the key 180, the mandrel 215 can then be rotated approximately one hundred and eighty degrees so that the key 180 is contained within the housing 175. An upward force is then applied to the run-in string 174, thereby creating an upward force on the mandrel 215 sufficient to overcome the shear strength of shearable connection 206. As the shearable connection 206 fails, an upper surface 221 of the pick-up nut 220 acts upon a flexible finger 241 of expander tube 240, urging the expander tube 240 upward along the inner surface of the locking dogs 200. An upper surface 207 of the flexible finger 241 contacts a lower surface 208 formed in the expander tube 240. As a reduced diameter portion 242 of the expander tube 240 passes under the locking dogs 200, the dogs 200 move inwards and out of contact with the groove 176 formed on the inner surface of the housing 175, thereby allowing the dogs 200, expander tube 240 and inner tube 185 to be removed from the assembly 140 along with the run-in string 174.

Figure 8:
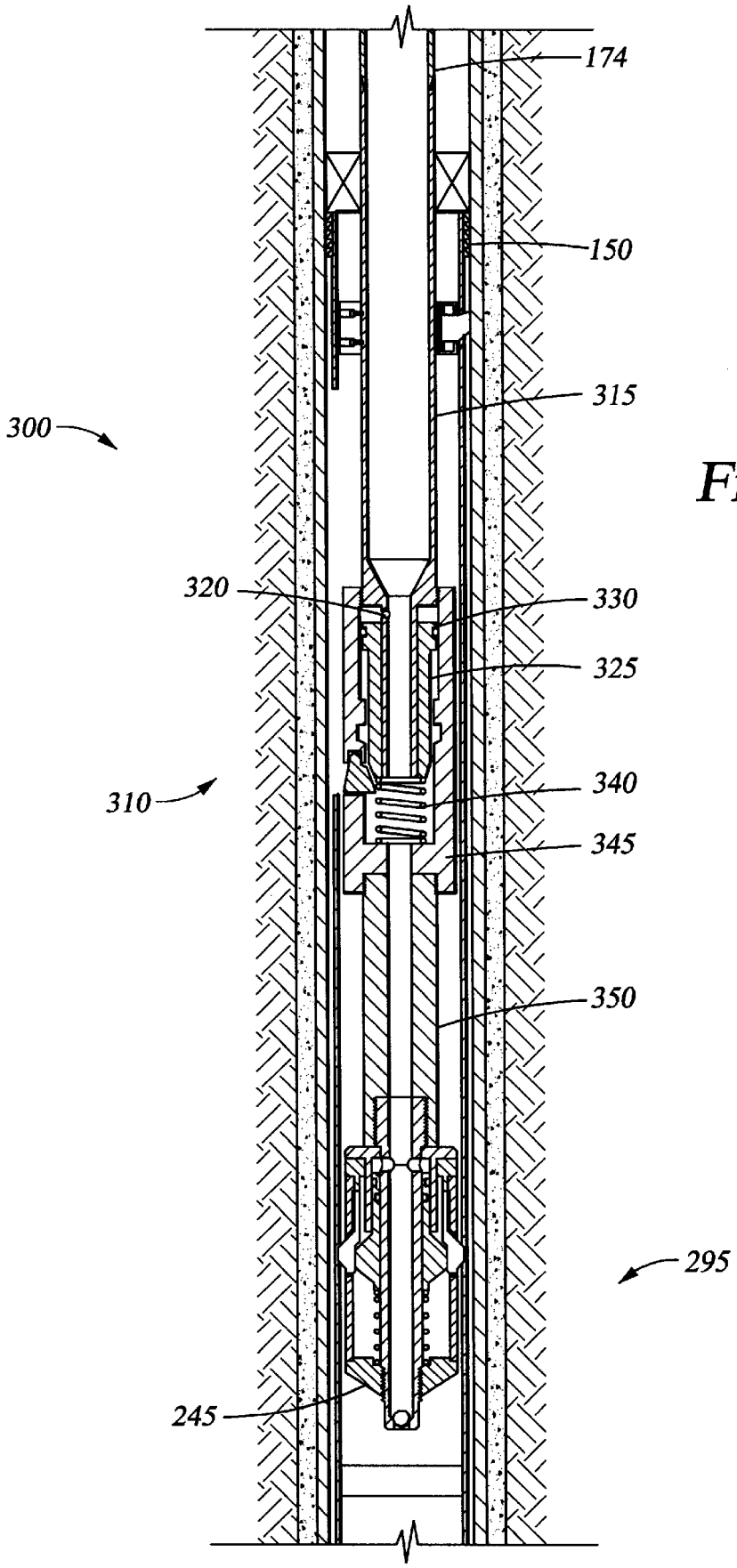
FIG. 8 is a section view of a hydraulic release mechanism used to separate a run-in string and the inner tube from the assembly.

FIG. 8 is a section view of another possible variation and embodiment of a release assembly utilizing a hydraulic release assembly 295 to separate the run-in string 174 and a hydraulically operated no-go assembly 310 from a tie back assembly 300. An upper portion of the no-go assembly 310 is threadably attached to a lower end of a mandrel 315. The upper end of the mandrel 315 is threadably attached at a lower end of the run-in string 174. The hydraulically operated no-go assembly 310 consists of a housing 345 that contains an inlet port 320 for hydraulic fluid to enter the assembly 310, a shifting sleeve 325, a sleeve seal 330, and a spring 340. An upper end of a connector tube 350 is threadably attached to a lower end of the housing 345. A lower end of the connector tube 350 is threadably attached to an upper end of a housing 245 for a hydraulic release assembly 295.

The hydraulic release assembly 295 consists of a housing 245 containing a collet 250, a locking sleeve 255, an inlet port 260, an upper sleeve seal 261, a lower sleeve seal 265, a ball 270 and a ball seat 275. The collet device 250 is locked into a retaining groove 280 on the inside of the liner 285 and carries the weight of the liner 285 as it is lowered into the wellbore 100. The ball seat 275 is located at the lower end of the hydraulic release housing 245, with a profile that allows a standard ball 270 dropped from surface to land and create a seal to allow pressure generated at surface to hydraulically manipulate devices in the no-go assembly 310 and the hydraulic release assembly 245.

Figure 9:
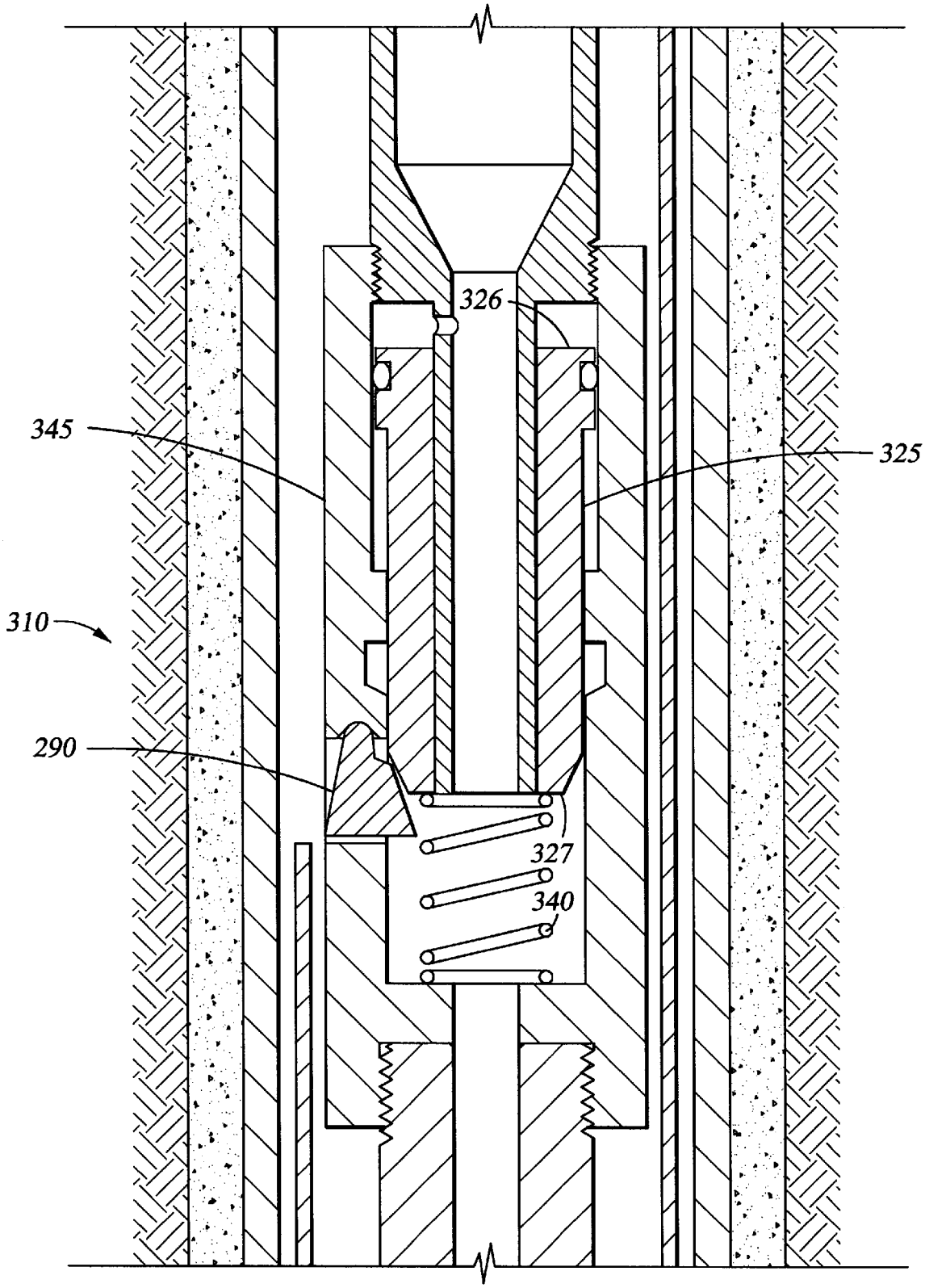
FIG. 9 is an enlarged view of a hydraulic no-go assembly with the no-go obstruction retracted.
Figure 10:
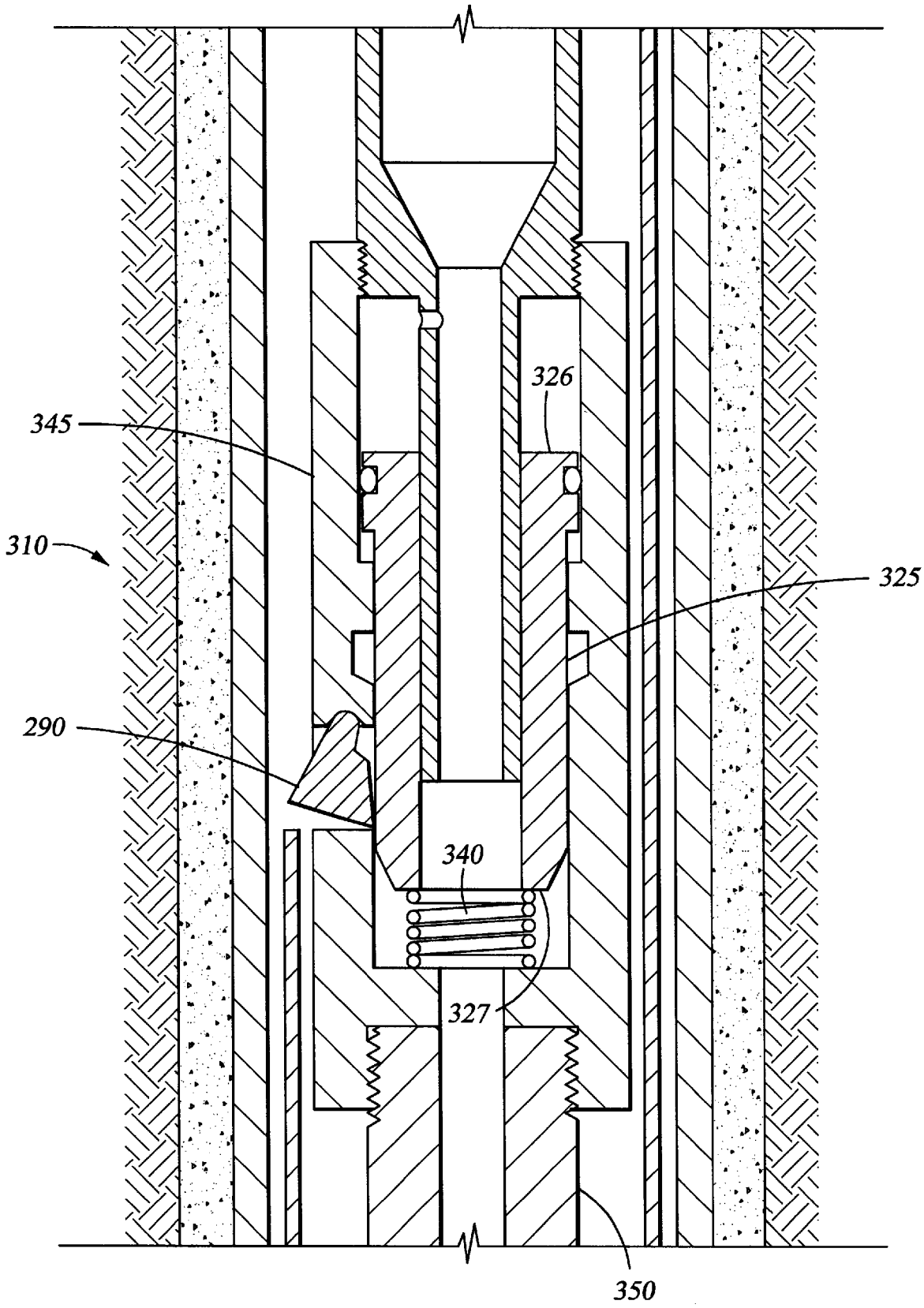
FIG. 10 is an enlarged view of a hydraulic no-go assembly with the no-go obstruction extended.

FIG. 9 is an enlarged view of the hydraulic no-go assembly 310, and FIG. 10 is an enlarged view of assembly 310 after hydraulic pressure has been increased to manipulate devices in the assembly 310. In FIG. 9, the spring 340 acts upon a lower surface 327 of the shifting sleeve 325 and holds the shifting sleeve 325 in an upper position. The no-go obstruction 290 is allowed to retract so that it does not extend beyond the housing 345.

Figure 12:
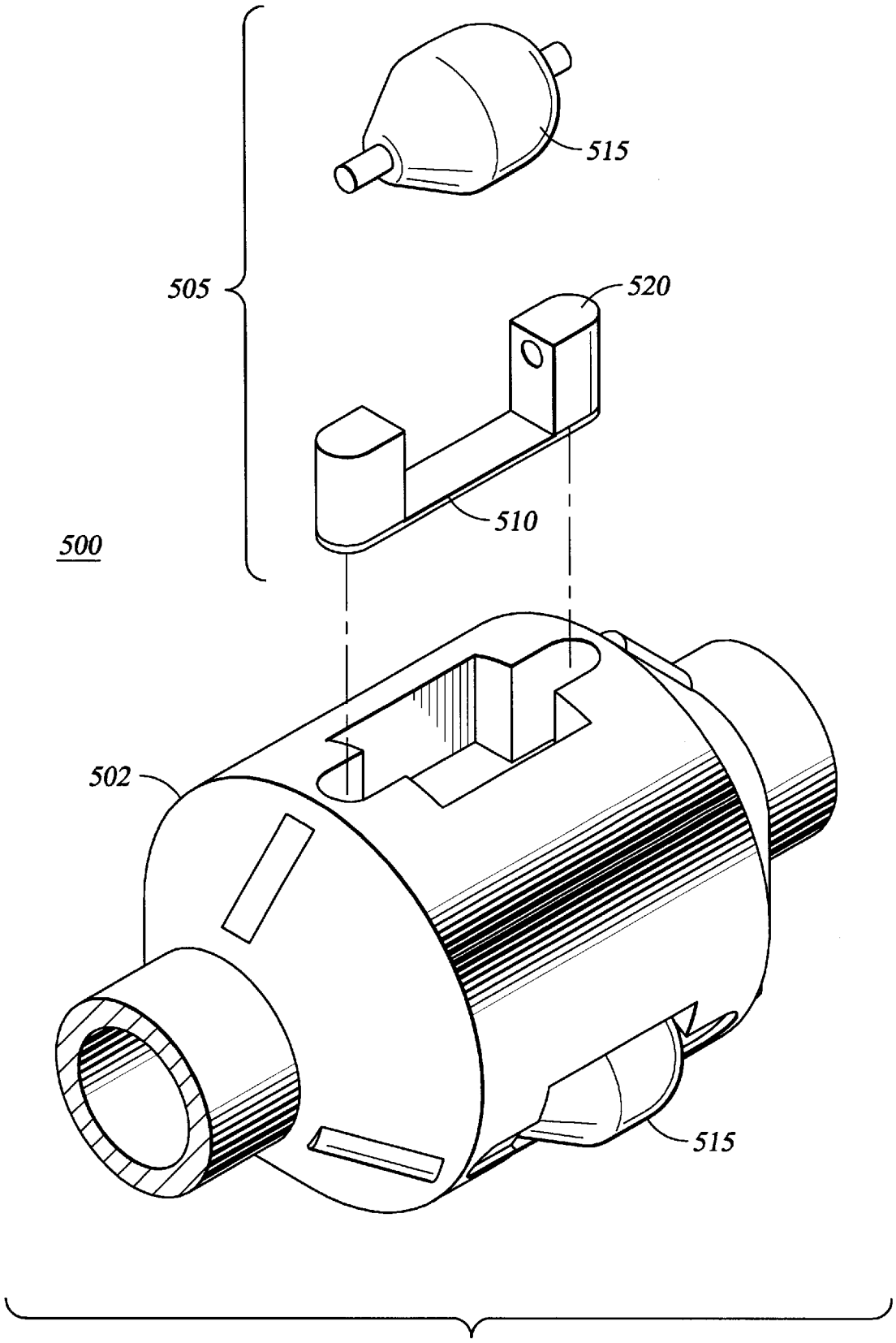
FIG. 12 is an exploded view of an expander tool.

In FIG. 10, hydraulic fluid has entered the inlet port 320 of the no-go assembly 310 and acted upon an upper surface 326 of the shifting sleeve 325. As the hydraulic pressure is increased, the force acting on the upper surface 326 of the shifting sleeve 325 overcomes the force of the spring 340 acting upon the lower surface 327 of the sleeve 325. This forces the sleeve 325 downward, thereby causing the no-go obstruction 290 to extend beyond the housing 345. With the no-go obstruction 290 extended as shown in FIG. 12, it may be used to contact a lower portion of a casing window and axially locate a tie back assembly in a primary wellbore, as previously discussed.

Figure 11:
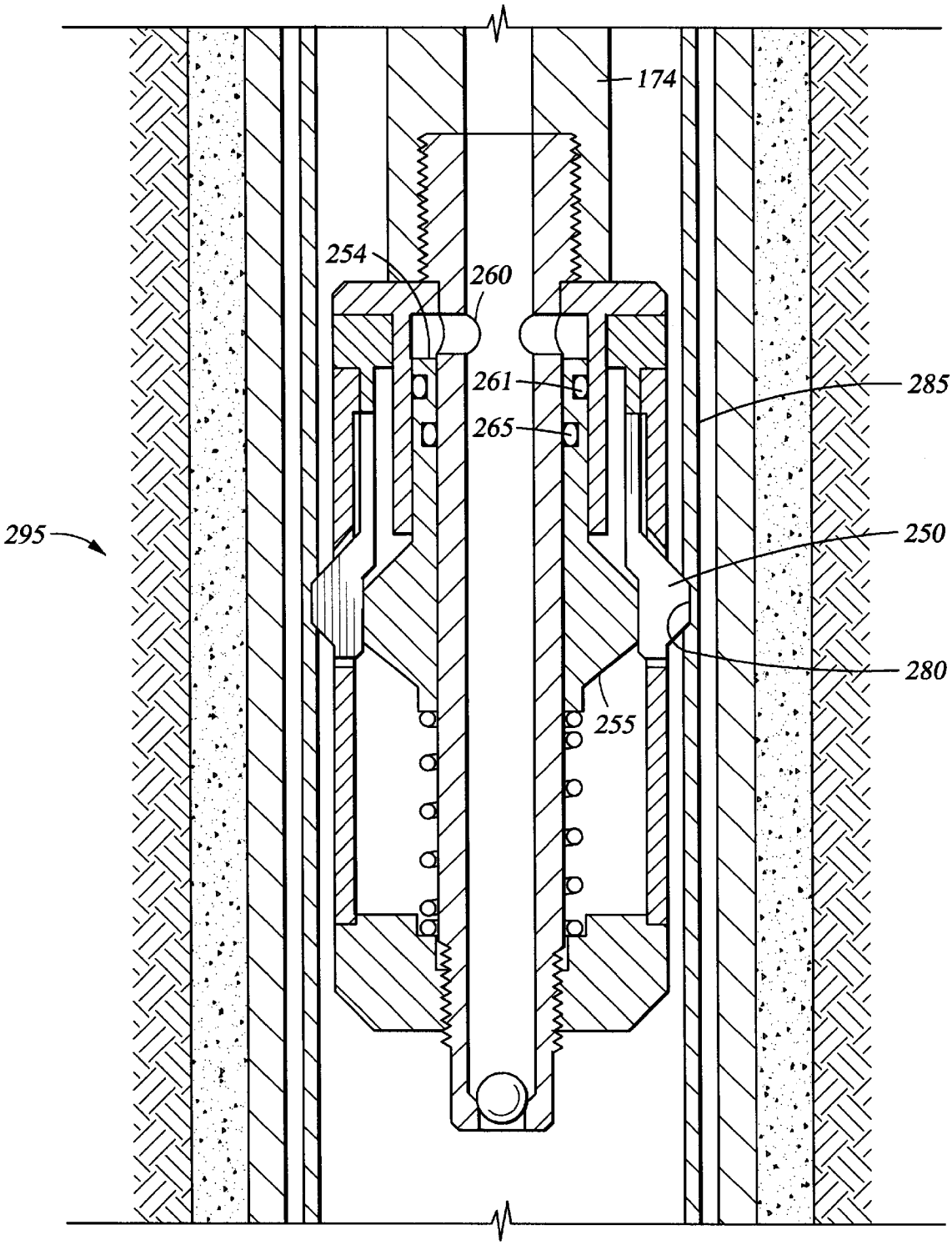
FIG. 11 is an enlarged view of a hydraulic release assembly.

In FIG. 8, after the tie back assembly 300 has been properly located and the liner hanger 150 has been set (as previously described), the hydraulic release assembly 295 is activated. FIG. 11 shows an enlarged view of the release assembly 295. As shown in the upper position, the locking sleeve 255 forces the collet 250 into the retaining groove 280 of the liner 285. Hydraulic fluid enters the inlet port 260, and as the fluid pressure is increased, upper 261 and lower 265 sleeve seals prevent bypass of the fluid and force the fluid to act on the upper surface 254 of the locking sleeve 255 to cause it to shift downward. The locking sleeve 255 is shifted downward at a pressure greater than that needed to activate the no-go assembly 310. As the locking sleeve 255 is shifted downward, the collet 250 is released from the retaining groove 280. Once the locking sleeve 255 is released from the retaining groove 280, the run-in string 174, no-go assembly 310 (not shown), and hydraulic release assembly 295 may be removed, leaving a primary and a lateral wellbore clear of obstructions.

In another possible variation and embodiment, a packer hanger or liner hanger could replace the current attachment mechanism between the assembly and the running tool. The inner tube could be permanently mounted to the assembly and remain in the well after setting, resulting in some reduction of the internal diameter of the assembly and a restricted access to both the liner as well as the main casing. Alternatively, the inner tube could be constructed from aluminum or a composite material and could be drillable or otherwise separable with the removal thereof from the wellbore. Also, the attachment mechanism between the inner tube, the assembly and the running tool could be changed from a mechanical to an electrical release or to a hydraulic release as will be described herebelow.

The assembly, including the housing could be constructed of a material other than steel, such as titanium, aluminum or any of a number of composite materials. The liner hanger could be used singularly without the packer hanger if there is no requirement to seal off the annulus between the tie back assembly and the inside of the main casing. The key could be added to the tie back assembly and become a permanent fixture in the wellbore, instead of on the running tool where it is now located. The inner tube could be permanently mounted in the tie back assembly. The shearable connection in the release assembly could be replaced with a hydraulic disconnect or a ratchet thread C-ring assembly. A standard packer hanger could be modified through the addition of additional slip devices to allow the packer hanger used singularly, or a device known as a liner hanger/packer, which is well known in the industry, can be used. Standard hanger devices could be replaced by custom designed slip means. These devices can be either mechanically, hydraulically or electrically set. The tubular section can be constructed of various materials in addition to steel, such as titanium or high strength composites. The liner window keyway could be replaced by a different type of control device, such as a device containing machined grooves of known diameter and diameter into which spring loaded keys lock, which is well known in the industry. Additionally, the key on the running tool could be removed and placed on either the tie back assembly or on the inner tube. The running tool currently utilizes a mechanical release from the tie back assembly, which could be converted to an electrical or a hydraulic release.

Additionally, the assembly can be used with only the key and keyway or with only the no-go obstruction. These variations are within the scope of the invention and are limited only by the operators needs in a particular job.

In order to use the assembly, the packer hanger is threadably connected on its lower end to the liner hanger. The liner hanger is threadably connected on its upper end to the packer hanger and on its lower end to the tie back assembly. The liner is threadably connected on its lower end to the swivel. The swivel is threadably connected on its lower end to the upper end of the liner. The inner tube is located on the inside of the housing of the tie back assembly, and connected to both the tie back assembly and running tool by locking dogs which are attached on the inside of the housing of the tie back assembly. The running tool contains a running mandrel that extends through the tie back assembly.

The steps involved in installing the methods and apparatus of this invention begin with drilling the primary wellbore and installing the main casing according to standard industry practices. The main casing may contained premilled openings, or windows, or these window openings may be created downhole using standard milling practices which are well known in the industry, as shown in FIG. 1, and which are described below.

The basic steps involved to use the assembly begin with setting a packer anchor device at the depth at which a lateral borehole is to be initiated. The packer anchor is then surveyed using standard survey devices such as a "steering tool" or surface reading gyro, to determine the orientation. Next, a whipstock is set on surface and is run into the wellbore and landed in the packer anchor device causing the inclined face of the whipstock to be oriented in the correct direction, as shown in FIG. 1.

An opening in the wall of the casing, commonly referred to as a window, is then milled using standard industry procedures, which are well known in the industry. The lateral borehole is also directionally drilled to the required depth using standard directional drilling techniques.

In the case of a premilled window, a keyway is installed at the upper and/or lower end of the window at the surface of the well. In the case of a downhole milled window, a keyway is milled or formed in the upper end of the window using apparatus and techniques which are the subject of an additional patent application by the same inventor. The whipstock and anchor packer are removed from the main casing, as shown in FIG. 2.

The tie back assembly is made up on surface and run into the well on a running tool. A bent section of tubular, referred to as a "bent joint", is placed on the lower end of the liner section and run into the well to the elevation of the window. The tie back assembly is threadably attached to the upper end of the liner. The liner is lowered into the main casing on the end of the drill pipe, or work string, until the bent joint reaches the elevation of the window. The bent joint is directed into the lateral borehole through the casing window opening, as shown in FIG. 3.

When the tie back assembly reaches the window depth in the main casing, the assembly is rotated until the outwardly-biased key engages the perimeter of the window, as shown in FIG. 4. The assembly is raised until the key lands in the upper keyway of the window and an increase in pick up weight is seen at the surface. The tie back assembly is now oriented correctly, that is, the liner window is in correct angular orientation with respect to the inner bore of the main casing.

The tie back assembly is then lowered until the inner tube engages the lower end of the window, preventing any further forward motion, as shown in FIG. 5. The tie back assembly is now oriented correctly, that is, the liner window is in correct position with respect to the window in the main casing.

The liner hanger may be set by dropping a ball, which lands in the ball seat at the lower end of the running tool, as shown in FIG. 6. Hydraulic pressure from the surface is applied, setting the liner hanger. Additional pressure may be applied, causing the ball to shear and exit through the bottom opening in the running mandrel. Weight is applied from the surface to mechanically set the packer hanger in compression.

The key is then disengaged from the housing and the drill pipe is raised until the pick-up nut portion at the bottom end of the running mandrel engages the expander tube, forcing the tube to shift upwardly and releasing the locking dogs. This releases the running tool and the inner tube from the tie back assembly. Continued upward force is applied and the running tool and inner tube are removed from the well. The well is now ready for completion operations.

Re-entry access to the lateral borehole and placement of completion equipment, such as packers, can be completed using the liner window keyway at the upper end of the liner window, shown in FIG. 7. The apparatus and methods to undertake this task will be disclosed in a different patent pending application.

In another variation of the invention, the hanger and/or the packer are replaced with an expandable connection between the tie back assembly and the main casing. FIG. 12 is an exploded view of an expander tool 500 having a plurality of radially expandable members 505 that are constructed and arranged to extend outwards to contact and to expand a tubular past its elastic limits. The members 505 consist of a roller member 515 and a housing 520. The members are disposed within a body 502. The tool is run into the wellbore on a separate string of tubulars and the tool is then operated with pressurized fluid delivered from the run-in string to actuate a piston surface 510 behind each housing 520. In this embodiment, the assembly is run into the well and oriented with respect to the window through the use of a key and keyway and a no-go obstruction as described herein. Thereafter, instead of actuating a hanger and a packer, an expansion tool 500 is run into the wellbore and with axial and/or rotational movement, the upper portion of the housing of the assembly is expanded into hanging and sealing contact with casing therearound. After the liner is fixed in the lateral wellbore through expansion, cement can be pumped through the run-in string and liner to the lower end of the lateral wellbore where it is circulated back up in the annulus between the liner and the lateral borehole. In one embodiment, the expander tool is run into the wellbore with the tie back assembly and a temporary connection ties the expander tool and the tie back assembly together as the assembly is located with respect to the casing window. In another variation, the tools string used to run and position the liner is also used to expand the upper portion of the housing of the assembly.

In additional to the forging embodiments, the present invention can be used with a flush mount tie back assembly, wherein the lateral liner terminates at a window in the casing of the primary wellbore. As mentioned herein, flush-type arrangements require a rather precise fit between the upper portion of the liner and the casing window. This precise fit can be facilitated and accomplished using the key and no-go obstruction of the present invention. In one aspect, a liner string with a flush-type upper tie back portion can be run into the wellbore and inserted into a lateral bore hole with the use of a bent joint as described herein. A run-in string of tubulars transports the liner string and is temporarily connected thereto by any well known means, like a shearable connection. The window has either a key way formed in its upper portion for a mating relationship with a key located on the running tool, or the key located on the running tool simply interacts with the apex of the window in order to position and orient the liner with respect to the window. Similarly, a no-go obstruction formed on the underside of the running tool can position the liner axially with respect to the window.

Figure 13:
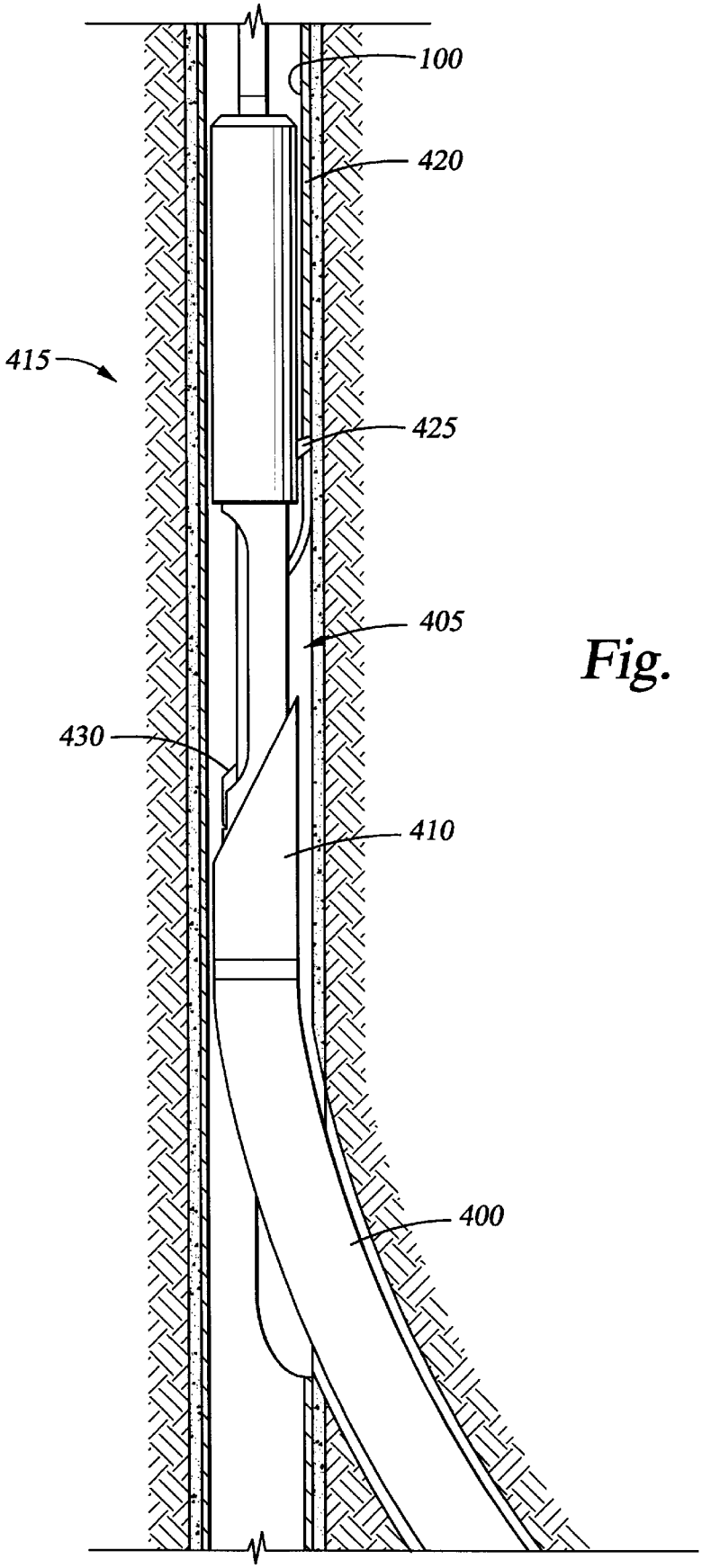
FIG. 13 is a section view of a flush-type tie back system in a run in position in a cased wellbore.

FIG. 13 is a section view of a wellbore 100 having a window 405 formed therein with a liner 400 extending therethrough. The liner 400 includes a flush mount hanger 410 which is attached at an upper end to a run-in tool 415. The hanger 410 includes an angled upper portion having an angle of about 3–5 degrees. The hanger 410 is constructed and arranged to be lowered through the window 405 in the casing 420 and to be fixed at the window 405, whereby no part of the hanger 410 extends into the primary wellbore 100. As with previous embodiments, the run-in tool 415 includes an outwardly extending key 425 to properly rotationally orient the hanger 410 with respect to the casing window 405. Additionally, a no-go obstruction 430 may be utilized on an opposite side of the run-in tool 415 to properly axially locate the hanger 410 with respect to the window 405.

Figure 14:
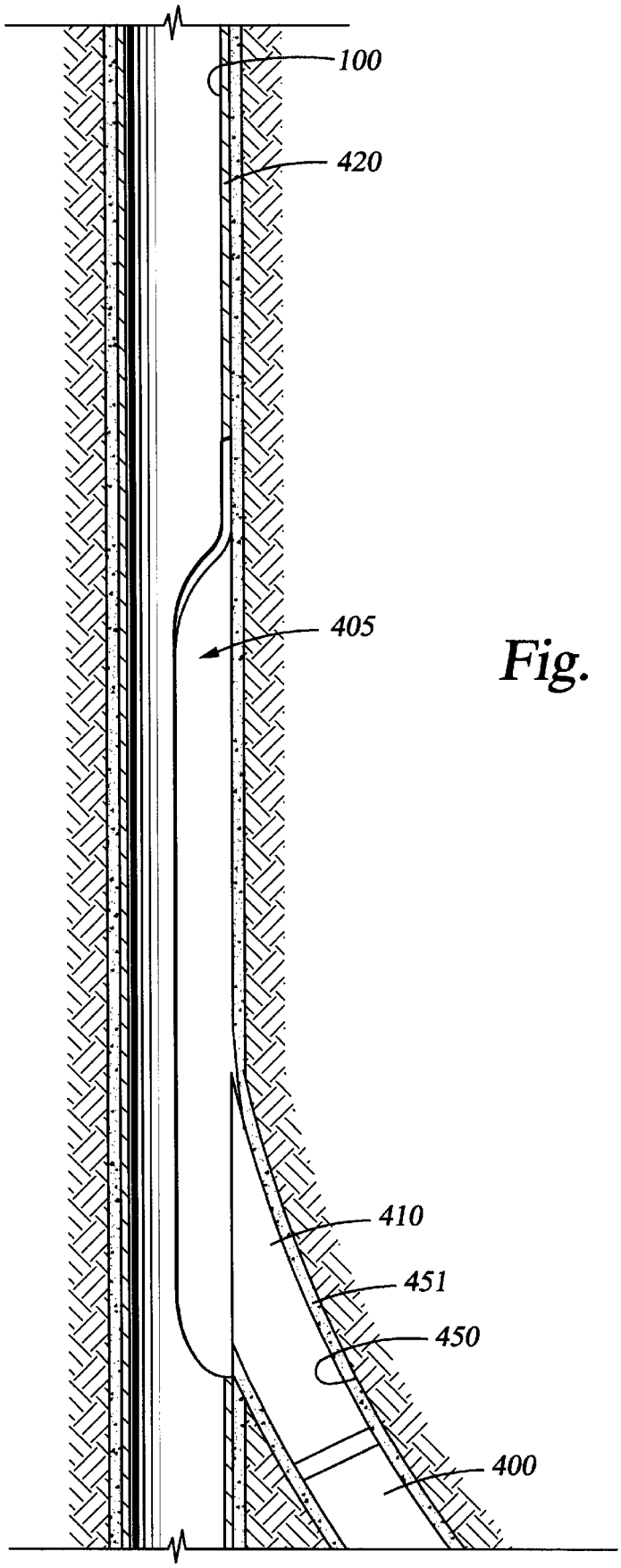
FIG. 14 is a section view of the flush-type tie back assembly installed in the window of the casing and the liner cemented in the lateral wellbore.

FIG. 14 is a section view of a wellbore 100 whereby the flush-type hanger 410 has been installed in the lateral wellbore 450. Visible in FIG. 14 is the upper edge of the flush mount which is arranged with respect to the casing window 405 whereby no part of the tie back assembly 410 extends into the primary wellbore 100. In FIG. 14, the run-in tool 415 has been removed along with the key and no-go obstruction which facilitated the positioning of the tie back assembly with respect to the casing window. Disposed between the liner and the lateral wellbore 450 is an annular area filled with cement 451.

Typically, the assembly including the flush mount tie back assembly in the liner would be run into the wellbore and, using either/or the key and no-go obstruction the assembly would be properly positioned at the casing window. Thereafter, while held in place by the run-in tool and the run-in string, cement can be pumped through the liner and ultimately pumped into an annular area formed between the outer surface of the liner and the inner surface of the lateral borehole. Additional fluid can be pumped through the liner to clear the cement and, after the cement cures the run-in tool can be removed from the tie back assembly.

By utilizing the methods and apparatus disclosed herein, at least the junction of a lateral wellbore can be cemented, thereby creating a Technical Advancement of Multilaterals (TAML) level 4 junction.

While the foregoing is directed to embodiments of the present invention, other and further embodiments of the invention may be devised without departing from the basic scope thereof, and the scope thereof is determined by the claims that follow.

What is claimed is:

1. An apparatus for locating a first tubular with respect to a window in a second tubular, comprising:

at least one member extending in a direction away from an outer wall of the first tubular for aligning the first tubular with respect to the window of the second tubular, and at least one additional member extending in a direction away from a second outer wall of the first tubular, the second outer wall being substantially, circumferentially opposite the first outer wall.

2. The apparatus of claim 1, wherein the at least one member includes a key formed on an outer wall of the first tubular.

3. The apparatus of claim 2, wherein the at least one additional member is a no-go obstruction.

4. The apparatus of claim 2, wherein the outer wall of the first tubular is located adjacent an upper portion of the window and the opposing outer wall is located adjacent a lower portion of the window.

5. The apparatus of claim 4, wherein the first tubular is a liner and the second tubular is a casing in a wellbore.

6. The apparatus of claim 5, wherein the liner extends through the window in the casing with an upper portion of the liner remaining within a bore defined by the interior of the casing.

7. The apparatus of claim 5, wherein the liner terminates at the window in the casing.

8. The apparatus of claim 5, wherein the liner includes a swivel disposed therein to permit independent rotational movement between an upper and a lower portion of the liner.

9. The apparatus of claim 8, wherein the liner includes a bent joint at a lower end thereof to facilitate the insert on of the liner into the window.

10. The apparatus of claim 6, wherein the upper portion of the liner includes a tie back assembly for permitting the liner to be tied back to the surface of the well.

11. The apparatus of claim 10, wherein the tie back assembly includes a hanger to fix the tie back assembly and liner within the casing.

12. The apparatus of claim 11, wherein the tie back assembly further includes a packer for sealing an annulus between the tie back assembly and the casing therearound.

13. The apparatus of claim 10, wherein the tie back assembly includes a liner window formed in a housing thereof, the liner window formed in a wall thereof and constructed and arranged to permit a substantially unobstructed passage between an upper portion of the casing and a lower portion of the casing.

14. The apparatus of claim 13, wherein the unobstructed passage between the upper and lower portions of the casing is defined by the inside diameter of the housing.

15. The apparatus of claim 14, wherein the tie back assembly includes an inner tube coaxially disposed within the liner.

16. The apparatus of claim 15, wherein the inner tube is removable.

17. The apparatus of claim 16, wherein the no-go obstruction is located on the removable inner tube.

18. The apparatus of claim 17, wherein the key is located on the housing and intersects a key way or natural apex formed at the upper portion of the window.

19. The apparatus of claim 18, wherein the key prevents upward and rotational movement of the liner with to the window.

20. The apparatus of claim 16, wherein the key is located on the removable inner tube and extends through an aperture formed in a wall of the housing to intersect the window.

21. The apparatus of claim 17, wherein the no-go obstruction intersects a lower portion or apex of the window to prevent downward movement of the liner with respect to the window.

22. The apparatus of claim 21, wherein the key and the no-go obstruction are spring biased.

23. The apparatus of claim 22, wherein the no-go obstruction and the key operate sequentially, the no-go extending outwards from the inner tube only after the key intersects the window.

24. The apparatus of claim 23, wherein the apparatus is run into the wellbore on a run-in string of tubulars.

25. The apparatus of claim 24, wherein the hanger and packer are set with pressurized fluid delivered from the run in string.

26. The apparatus of claim 25, wherein the pressurized fluid terminates in a tubular member extending from the lower end of the run in string and sealable with a ball and ball seat.

27. The apparatus of claim 26, wherein the tie back assembly includes a release assembly permitting a portion of the tie back assembly to be removed from the wellbore.

28. The apparatus of claim 27, wherein the release mechanism includes:

a central tubular mandrel;

a lifting surface formed on the lower outside portion of the mandrel;

a sleeve having a smaller and larger outer diameters disposed about the mandrel and attached thereto with a first temporary connection, the sleeve having a lower surface in contact with the lifting surface therebelow;

an inner tube disposed around the sleeve, the tube attached to the sleeve with a second shearable connection; and at least two dog members temporarily connecting the inner tube to the housing of the tie back assembly.

29. The apparatus of claim 27, wherein the release mechanism includes a hydraulic release assembly including:

a central tubular;

a port between the tubular and a piston surface formed on an annular sleeve disposed around the tubular, the annular sleeve, when shifted to a second position, causing the obstruction to extend outwards from the sleeve;

a second port between the tubular and a release piston, the piston movable between a first and second position;

at least two flexible finger members normally extending into a groove formed in the housing of the tie back assembly;

whereby when in the second position, the release piston permits movement of the fingers out of engagement with the groove.

30. The apparatus of claim 10, whereby the tie back assembly is fixed in the interior of the casing through the radial expansion of a tubular member into the contact with the casing.

31. A method of releasing a tie back assembly with a removable inner tube and key, comprising:

applying a first downward force to a central mandrel to break a first shearable connection between the mandrel and a sleeve therearound;

moving the mandrel downwards to cause a spring biased key to retract; rotating the mandrel a least 15 degrees whereby the key no longer intersects a window in a tubular therearound;

applying an upwards force on the mandrel to break a second shearable connection between the sleeve and an inner tube therearound; and removing the mandrel, inner tube and sleeve from the wellbore.

32. A tie back assembly comprising:

a hanger for hanging the assembly in a central wellbore;

a packer for sealing an annular between the assembly and the central wellbore;

a tubular housing disposed between the hanger and an upper end of a liner string, the tubular housing having an access window formed therein to provide access between an upper an lower portions of the primary wellbore;

a key located on an outer wall of the tubular housing for aligning the assembly with respect to a casing window from which the lateral wellbore extends; and an inner tube dispose coaxially within the housing, the inner tube removable therefrom with a run-in string and having a no-go obstruction formed on an outer wall thereof, the obstruction extending through the access window of the liner.

33. The tie back assembly of claim 32, wherein the key is removable.

34. A method of using a tie back assembly, comprising:

running a liner with the assembly disposed thereupon into a central wellbore;

causing the liner to extend through a window formed in casing and into a lateral wellbore extending therefrom;

locating a member formed on the liner in a mating formation formed on the window in order to orient the liner in respect to the window; and fixing the liner in the lateral wellbore.

35. The method of claim 34, wherein the member is a key and the formation is a key way or natural apex at the upper portion of the window.

36. The method of claim 35, wherein the member further includes an obstruction located on the liner opposite the key, the obstruction for location in the lower portion of the window.

37. The method of claim 36, further including hanging the assembly in the central wellbore.

38. The method of claim 37, further including setting a packer to isolate an annular area between the assembly and the central wellbore.

39. The method of claim 38, wherein the assembly is run into the wellbore on a run-in string of tubulars.

40. The method of claim 39, wherein the liner is cemented in the lateral wellbore.

41. A method of using a tie back assembly, comprising:

running a liner with the assembly disposed thereupon into a central wellbore;

causing the liner to extend through a window formed in casing and into a lateral wellbore extending therefrom;

locating a member formed on the liner in a mating formation formed on the window in order to orient the liner in respect to the window; and fixing the liner in the lateral wellbore such that the upper end of the liner does not extend into the central wellbore.

42. The method of claim 41, wherein the member is a key and the formation is a key way or natural apex at the upper portion of the window.

43. The method of claim 42, wherein the member further includes an obstruction located on the liner opposite the key, the obstruction for location in the lower portion of the window.

44. The method of claim 43, wherein cement is pumped through the liner and around the intersection of the liner and the central wellbore prior to removing the running tubulars.

45. The method of claim 44, wherein the cemented junction represents a Level 4 category under the Technical Advancement of Multilaterals classification system.

46. The method of claim 42, wherein the assembly is run into the wellbore on a run-in string of tubulars.

47. A method of using a tie back assembly, comprising:

running a liner with the assembly disposed thereupon into a central wellbore;

causing the liner to extend through a window formed in casing and into a lateral wellbore extending therefrom;

locating a member formed on the liner in a mating formation formed on the window in order to orient the liner in respect to the window;

fixing the liner in the lateral wellbore such that the upper end of the liner extends into the central wellbore; and expanding the portion of the liner which extends into the central wellbore such that the outer surface of the liner contacts the inner surface of the central wellbore with sufficient force to prevent movement or rotation of the portion of the liner within the central wellbore.

48. The method of claim 47, wherein the member is a key and the formation is a key way or natural apex at the upper portion of the window.

49. The method of claim 48, wherein the member further includes an obstruction located on the liner opposite the key, the window for location in the lower portion of the window.

50. The method of claim 49, wherein cement is pumped through the liner and around the intersection of the liner and the central wellbore prior to removing the running tubular.

51. The method of claim 50, wherein the cemented junction represents a Level 4 category under the Technical Advancement of Multilaterals classification system.

52. The method of claim 51, further including hanging the assembly in the central wellbore.

53. The method of claim 52, further including setting a seal to isolate an annular area between the expanded portion of the liner and the central wellbore.

54. The method of claim 53, wherein the assembly is run into the wellbore on a run-in string of tubulars.

55. The method of claim 54, wherein the liner is cemented into the lateral wellbore.

56. A method of using a tie back assembly, comprising:

running a lateral liner with the assembly disposed thereupon into a central wellbore;

causing the lateral liner to extend through a window formed in casing and into a lateral wellbore extending therefrom;

locating a member formed on the lateral liner in a mating formation formed on the window in order to orient the lateral liner in respect to the window; and fixing the liner in the lateral wellbore.

* * * * *

UNITED STATES PATENT AND TRADEMARK OFFICE

CERTIFICATE OF CORRECTION

PATENT NO. : 6,619,400 B2
DATED : September 16, 2003
INVENTOR(S) : Brunet

It is certified that error appears in the above-identified patent and that said Letters Patent is hereby corrected as shown below:

Column 11,
Line 45, please change “insert on” to -- insertion --.

Column 13,
Line 23, please change “upper an lower” to -- upper and lower --.

Signed and Sealed this

Eleventh Day of November, 2003

JAMES E. ROGAN
*Director of the United States Patent and Trademark Office*